US009971309B2

(12) United States Patent
Winkler et al.

(10) Patent No.: US 9,971,309 B2
(45) Date of Patent: May 15, 2018

(54) MECHANICAL TIMEPIECE MOVEMENT PROVIDED WITH A FEEDBACK SYSTEM FOR THE MOVEMENT

(71) Applicant: ETA SA Manufacture Horlogere Suisse, Grenchen (CH)

(72) Inventors: Pascal Winkler, St-Blaise (CH); Gianni Di Domenico, Neuchatel (CH); Thierry Conus, Lengnau (CH); Jean-Luc Helfer, Le Landeron (FR)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days. days.

(21) Appl. No.: 15/196,215

(22) Filed: Jun. 29, 2016

(65) Prior Publication Data

US 2017/0045861 A1 Feb. 16, 2017

(30) Foreign Application Priority Data

Aug. 11, 2015 (EP) ..... 15180503

(51) Int. Cl.

| | |
|---|---|
| ***G04C 3/10*** | (2006.01) |
| ***G04B 15/10*** | (2006.01) |
| ***G04C 3/02*** | (2006.01) |
| ***G04B 17/26*** | (2006.01) |
| ***G04B 17/28*** | (2006.01) |

(Continued)

(52) U.S. Cl.

CPC ..... *G04C 3/107* (2013.01); *G04B 15/10* (2013.01); *G04B 17/20* (2013.01); *G04B 17/26* (2013.01);

(Continued)

(58) Field of Classification Search

CPC ..... G04B 15/10; G04B 17/20; G04B 17/26; G04B 17/28; G04B 18/028; G04B 18/04;

(Continued)

(56) References Cited

U.S. PATENT DOCUMENTS 2,248,165 A * 7/1941 Dicke ..... G04C 11/087 368/52
3,134,220 A * 5/1964 Meisner ..... G04C 3/165 318/400.29

(Continued)

FOREIGN PATENT DOCUMENTS

FR 2 207 303 6/1974
FR 2 305 768 10/1976
GB 378511 A * 8/1932 ..... G04C 11/84

OTHER PUBLICATIONS

European Search Report dated Feb. 19, 2016 in European Application 15180503, filed on Aug. 11, 2015 ( with English Translation).

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

The mechanical timepiece movement includes at least one barrel, a set of gear wheels driven at one end by the barrel, and an escapement mechanism of a local oscillator with a resonator in the form of a sprung balance and a feedback system for the timepiece movement. The escapement mechanism is driven at another end of the set of gear wheels. The feedback system includes at least one precise reference oscillator combined with a frequency comparator to compare the frequency of the two oscillators and a mechanism for regulating the local oscillator resonator to slow down or accelerate the resonator based on the result of a comparison in the frequency comparator.

20 Claims, 4 Drawing Sheets

(51) Int. Cl.

| | |
|---|---|
| ***G04B 17/20*** | (2006.01) |
| ***G04B 18/02*** | (2006.01) |
| ***G04B 18/04*** | (2006.01) |
| ***G04D 7/10*** | (2006.01) |
| ***G04D 7/12*** | (2006.01) |

(52) U.S. Cl.
CPC ..... *G04B 17/28* (2013.01); *G04B 18/028* (2013.01); *G04B 18/04* (2013.01); *G04C 3/022* (2013.01); *G04C 3/10* (2013.01); *G04D 7/10* (2013.01); *G04D 7/1257* (2013.01)

(58) Field of Classification Search
CPC ..... G04C 3/022; G04C 3/10; G04C 3/101; G04C 3/107
See application file for complete search history.

(56) References Cited

U.S. PATENT DOCUMENTS 3,183,426 A * 5/1965 Haydon ..... G04C 5/005 368/132
3,512,351 A * 5/1970 Heeks ..... G04C 3/14 318/129
3,648,453 A * 3/1972 Aizawa ..... G04C 3/067 331/109
3,756,014 A * 9/1973 Zatsky ..... G04C 11/084 318/120
3,937,001 A * 2/1976 Berney ..... G04C 10/00 318/147
3,952,497 A * 4/1976 Schulz ..... G04C 10/00 368/158
4,106,280 A * 8/1978 Schulz ..... G04C 11/082 324/76.52
2010/0214879 A1* 8/2010 Lechot ..... G04B 15/00 368/101
2013/0070572 A1* 3/2013 Helfer ..... G04F 7/0823 368/168
2013/0170330 A1* 7/2013 Hessler ..... G04B 13/00 368/324
2016/0357149 A1* 12/2016 Stranczl ..... G04C 5/005

* cited by examiner

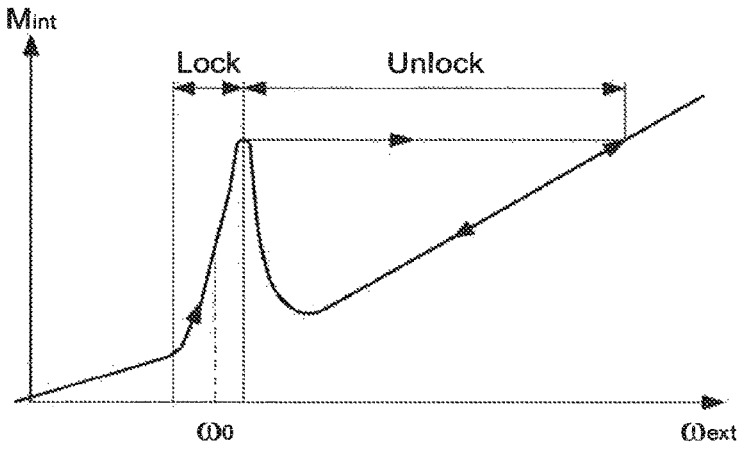
Fig. 4
Fig. 5
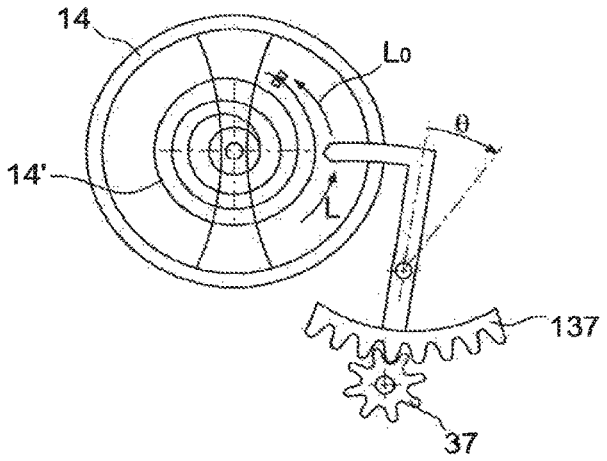
Fig. 6
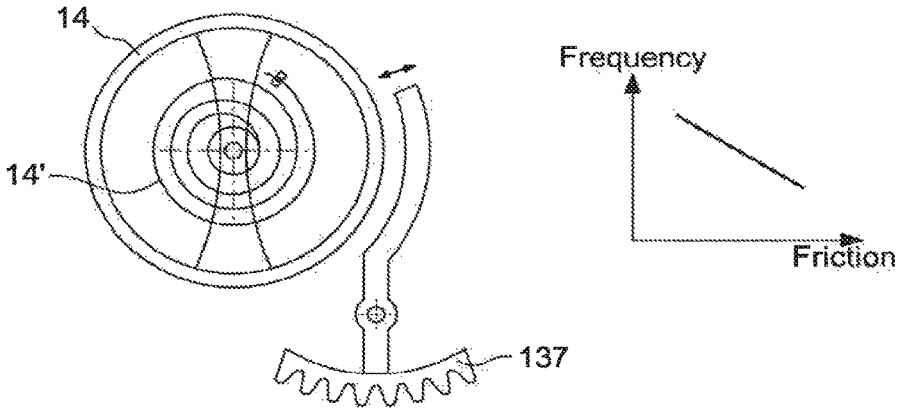

MECHANICAL TIMEPIECE MOVEMENT PROVIDED WITH A FEEDBACK SYSTEM FOR THE MOVEMENT

This application claims priority from European Patent Application No. 15180503.3 filed Aug. 11, 2015, the entire disclosure of which is hereby incorporated herein by reference.

FIELD OF THE INVENTION

The present invention concerns a mechanical timepiece movement provided with a feedback system for the movement.

BACKGROUND OF THE INVENTION

For many years, mechanical watch movements have undergone multiple improvements, particularly in order to adjust or regulate the oscillation frequency of the sprung balance used as the resonator for the local oscillator. The conventional mechanical watch movement and, in particular, its Swiss lever escapement, is characterized by its robustness to shocks experienced by the watch. This means that the state of the watch is, in general, unaffected by a one-time shock. However, the efficiency of such an escapement is not very good, for example around 30%. Further, the Swiss lever escapement does not permit the use of resonators with a high frequency or low amplitude.

WO Patent Application No. 2006/045824 A2 discloses a regulating member for returning the oscillating sprung balance to a position of equilibrium. An escapement is also provided for maintaining the oscillation of the balance wheel about its position of equilibrium. To achieve this, the balance wheel is connected to at least one movable permanent magnet, whereas the regulating member has a fixed permanent magnet so as to generate a magnetic field returning the balance to its position of equilibrium. There is no description regarding a feedback system capable of adjusting the oscillation frequency of the sprung balance, which constitutes a drawback.

In order to maintain a local oscillator resonator at a high frequency, the principle of the Swiss lever escapement has to be adjusted. To achieve this, an increase in the frequency of the regulating member requires more energy to maintain the oscillator. To reduce energy, it is possible to reduce the oscillator mass or inertia, to reduce the oscillation amplitude, to increase the quality factor of the oscillator, or to improve the energy transmission efficiency between the drive member and the regulating member. Thus, with a conventional Swiss lever escapement, too much energy is consumed by accelerating and stopping multiple times per second. Even if the Swiss lever and its wheel are made as light as possible, this does not make it easy to achieve a high frequency oscillator.

In a mechanical movement proposed by De Bethune, there is proposed a magnetic escapement with a continuous sinusoidal transmission of energy. A mechanical drive member transmits a torque force to a reduction gear train. At the end of said gear train, a magnetic rotor transmits energy to the resonator of the local oscillator, on which permanent magnets are fixed. The gear train speed is synchronized with the natural resonator frequency. The resonator, as the regulating member, controls the measurement of time. The speed of motion of the time indicator hands is controlled by a precise and regular division of time.

Such a resonator can replace the conventional sprung balance to better satisfy the requirements and constraints of high frequency oscillation in order to improve precision. There are no longer any specific points of attachment. The resonator is stiffer and permits the use of a first natural vibration mode. The quality factor is also higher than a conventional oscillator even at low amplitude.

However, according to the embodiment described above for the De Bethune movement, there is no shock resistance. In such conditions, the hands are likely to advance rapidly after any shocks. Further, there is no description of a feedback system for simply and precisely adjusting the oscillation frequency of a sprung balance, as in the present invention, which constitutes a drawback.

The invention seeks a means for using a local oscillator resonator, which has a high quality factor, a high frequency and/or low amplitude. This is achieved without relinquishing the robustness to shocks of a Swiss lever escapement.

SUMMARY OF THE INVENTION

It is therefore a main object of the invention to overcome the aforementioned drawbacks by proposing a mechanical timepiece movement provided with a feedback system capable of precisely adjusting the oscillation frequency of a local oscillator resonator of the mechanical movement.

To this end, the present invention concerns a mechanical timepiece movement which includes at least one barrel, a set of gear wheels driven at one end by the barrel, and an escapement mechanism of a local oscillator with a resonator in the form of a sprung balance, the escapement mechanism being driven at another end of the set of gear wheels, and a feedback system for the timepiece movement, wherein the feedback system includes at least one precise reference oscillator combined with a frequency comparator for comparing the frequency of the two oscillators and a mechanism for regulating the resonator of the local oscillator to slow down or accelerate the resonator based on the result of a comparison in the frequency comparator.

Particular embodiments of the mechanical timepiece movement are defined in the dependent claims 2 to 22.

One advantage of the mechanical timepiece movement according to the invention lies in the fact that it is possible to optimise the precision of the reference oscillator with no concerns as to its shock resistance and therefore to optimise the shock resistance of the local oscillator with no concerns as to its precision.

Another advantage is that it is possible to offer a product, which respects the aesthetic codes of watchmaking, as a result of the presence of a sprung balance as the local oscillator, while increasing precision through the use of a reference oscillator, which may be at a high frequency.

wherein the mechanical timepiece movement includes at least one barrel, a set of gear wheels driven at one end by the barrel, and an escapement mechanism of a local oscillator with a resonator in the form of a sprung balance, the escapement mechanism being driven at another end of the set of gear wheels, and a feedback system for the timepiece movement, wherein the feedback system includes at least one precise reference oscillator combined with a frequency comparator for comparing the frequency of the two oscillators and a mechanism for regulating the resonator of the local oscillator to slow down or accelerate the resonator based on the result of a comparison in the frequency comparator.

BRIEF DESCRIPTION OF THE DRAWINGS

The objects, advantages and features of the mechanical timepiece movement provided with a feedback system for the mechanical movement will appear more clearly in the following non-limiting description made with reference to the drawings, in which:

FIG. 4 shows the curve of the interaction torque between the exciter wheel and the tuning fork with permanent magnets of the reference oscillator as a function of the rotational speed of the wheel in the feedback system according to the first embodiment of FIG. 3, FIG. 5 shows a first embodiment of the regulating mechanism of the feedback system for adjusting the oscillation frequency of the local oscillator resonator according to the invention, FIG. 6 shows a second embodiment of the regulating mechanism of the feedback system for adjusting the oscillation frequency of the local oscillator resonator according to the invention.

DETAILED DESCRIPTION OF THE INVENTION

In the following description, all those components of the mechanical timepiece movement that are well known to those skilled in the art in this technical field will be described only in a simplified manner.

Figure 1:
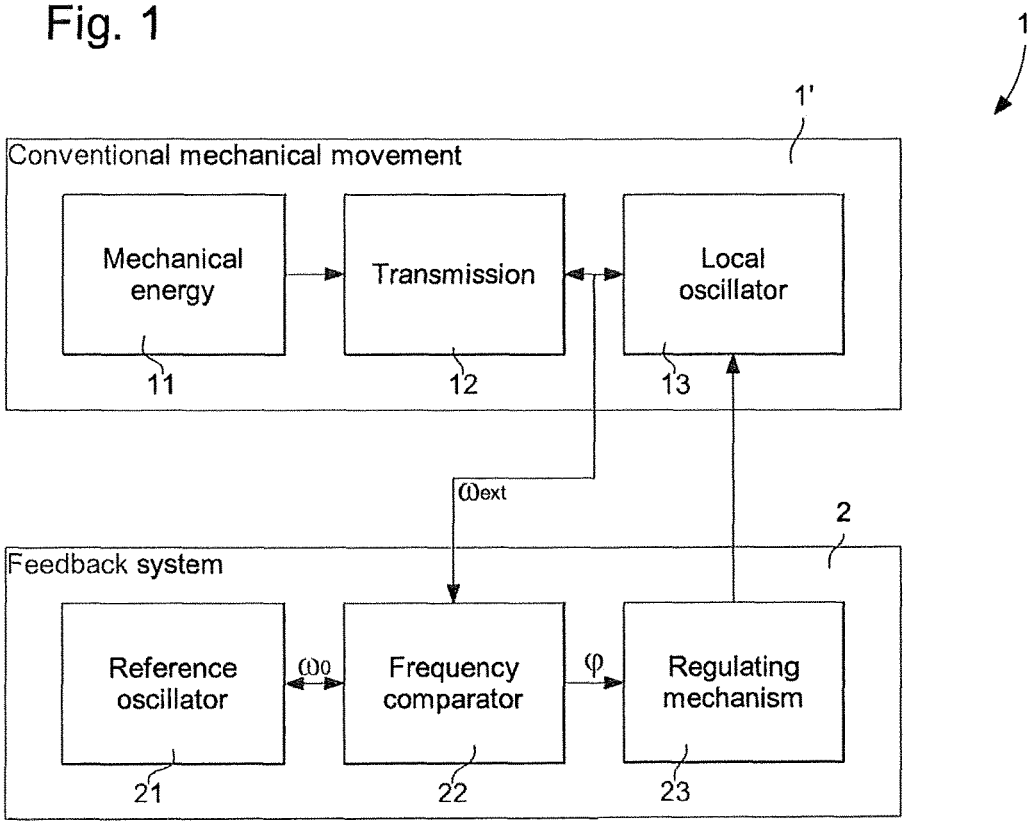
FIG. 1 shows a schematic view of the various components of the conventional mechanical timepiece movement in connection to the movement feedback system according to the invention.

As seen schematically in FIG. 1, there is illustrated a mechanical timepiece movement 1 provided with a feedback system 2 for precisely adjusting the rate or the operation of a conventional mechanical movement 1'. Conventional mechanical movement 1' includes a mechanical energy source 11, which is at least one barrel, a transmission assembly 12 and a local oscillator 13.

Transmission assembly 12 includes a set of gear wheels 12 driven at a first end wheel by barrel 11. The wheels of the set of gear wheels 12 are preferably toothed wheels. A last drive wheel of the set of gear wheels 12 drives an escapement mechanism of a local oscillator 13. This local oscillator 13 also includes a resonator, which takes the form of a sprung balance.

Feedback system 2 may be connected to the input of local oscillator 13 in order to control, in particular, the oscillation frequency of the local oscillator resonator. The connection between conventional mechanical movement 1' and feedback system 2 may be achieved via the last wheel of the set of gear wheels 12.

Feedback system 2 includes, firstly, a reference oscillator 21, which is precise, i.e. at least more precise than the resonator of local oscillator 13. Feedback system 2 further includes a frequency comparator 22, which is connected or combined with the reference oscillator or resonator 21 in order to compare the rate of the two oscillators 21, 13, and a regulating mechanism 23. This regulating mechanism 23 can adjust the oscillation frequency of the resonator of local oscillator 13 based on the result of the comparison in frequency comparator 22. The frequency of the resonator, such as the sprung balance of local oscillator 13, can thus be adjusted by the regulating mechanism, which will be explained hereinafter, to slow down or accelerate the local oscillator resonator.

It is to be noted that the "rate" or frequency of the local oscillator or of the reference oscillator, means the oscillation frequency or the rotational speed of a wheel in connection with the local oscillator and/or the reference oscillator.

Figure 2:
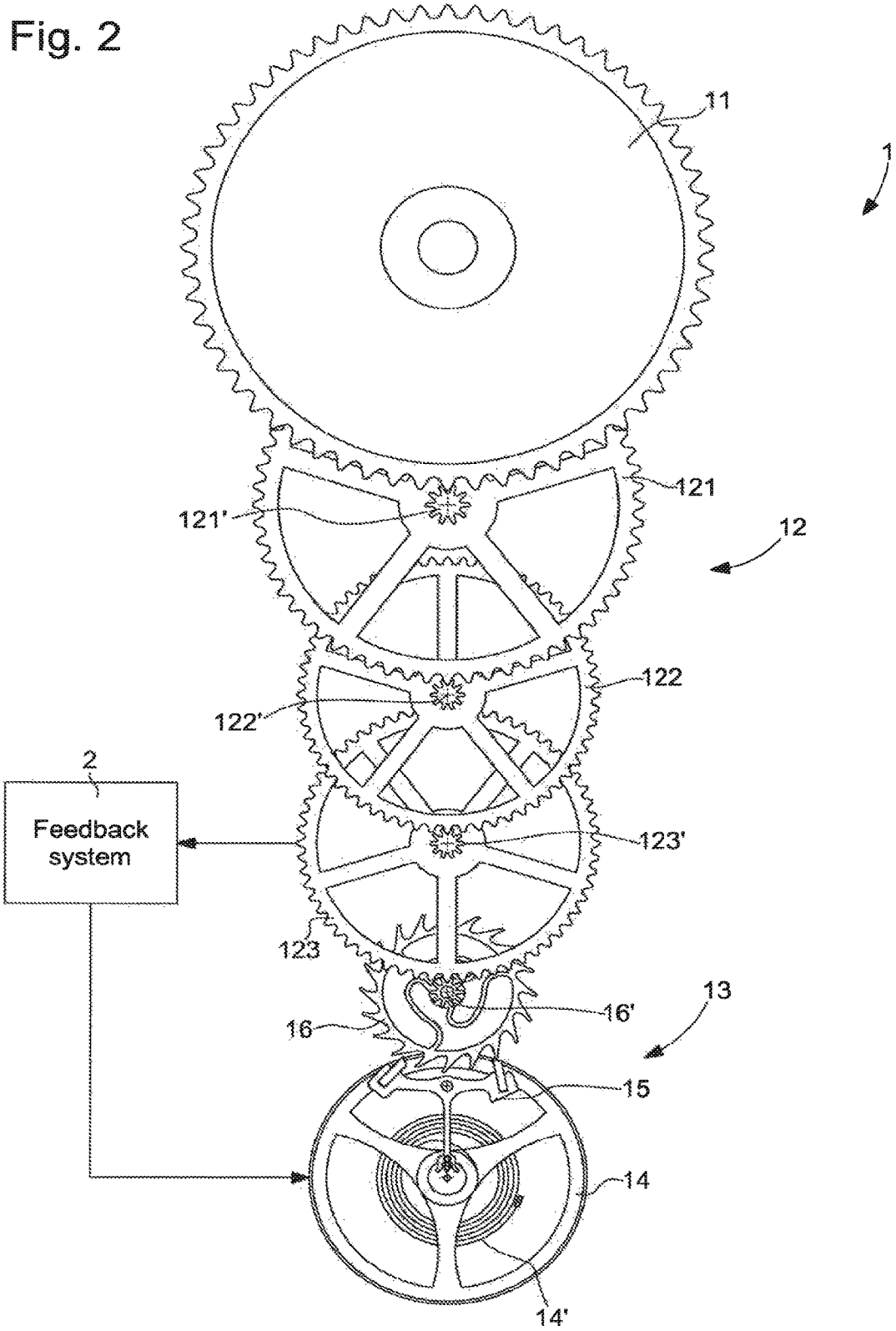
FIG. 2 shows in more detail the elements that make up the conventional mechanical movement in connection to the feedback system according to the invention.

FIG. 2 shows in more detail the various elements of the conventional mechanical movement of mechanical timepiece movement 1. The conventional mechanical movement thus includes barrel 11, which has an external toothing for meshing with a central pinion 121' of a first wheel 121 of the set of gear wheels 12. There is therefore obtained a multiplication of the rotational speed of first wheel 121 with respect to the rotational speed of the external barrel toothing.

The set of gear wheels 12 may also include a second wheel 122, whose central pinion 122' is driven by the external toothing of first wheel 121. There is also a multiplication of rotational speed with second wheel 122 rotating faster than first wheel 121. A third wheel 123 may also be provided and be driven, via a central pinion 123', by the external toothing of second wheel 122. There is also a multiplication of rotational speed with third wheel 123 rotating faster than second wheel 122. This third wheel 123 may be the last wheel of the set of gear wheels 12 for driving one or more time indicator hands of the mechanical watch.

The last wheel 123 of the set of gear wheels 12 drives an escapement mechanism of local oscillator 13. This escapement mechanism may include an escape wheel 16, whose central pinion 16' is driven by last wheel 123, and a Swiss lever 15 meshing with the escape wheel and cooperating in a conventional manner with a sprung balance 14. The sprung balance 14 has a balance spring 14' attached, on the one hand, at one end to the balance rotation staff and, on the other hand, at the other end to a balance spring stud which is generally attached to the watch plate. The oscillation frequency of the sprung balance is controlled and adjusted by feedback system 2.

Figure 3:
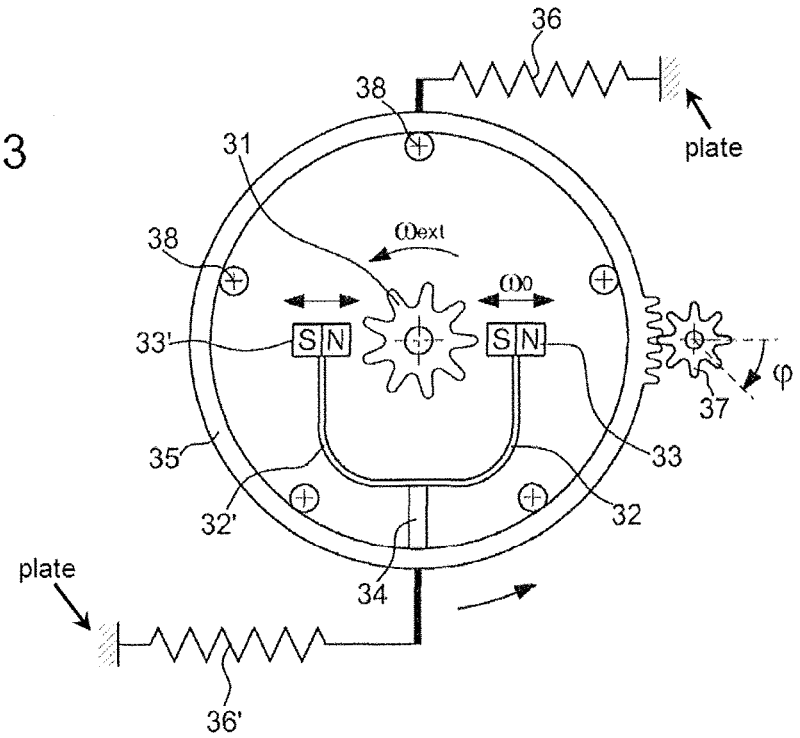
FIG. 3 shows a simplified view of the components of the feedback system according to a first embodiment and mainly the combination of the reference oscillator and the frequency comparator according to the invention.

A first embodiment of feedback system 2 is shown in FIG. 3. The feedback system includes a frequency discriminator. Since the local oscillator of the conventional mechanical movement is imprecise, but robust to shocks, said movement excites a reference oscillator or resonator 32, 32', 33, 33', which is more precise, of the feedback system. The rate or frequency of the reference resonator is thus compared to the rate or frequency of the local oscillator resonator by means of a frequency comparator 35, 36, 36'. The frequency comparator output controls an element of the regulating mechanism in order to adjust the rate of the local oscillator resonator.

It is to be noted that the reference resonator is combined with the frequency comparator. There is a magnetic interaction with a rotating wheel connected to the conventional mechanical movement to excite the reference resonator and to compare the rate or frequency of the oscillators.

An exciter wheel 31 can be directly connected to one of the wheels of the set of gear wheels of the conventional mechanical movement. This exciter wheel may also be one of the wheels of said set of gear wheels or there may be a multiplier or division arrangement between one of the wheels of the set and exciter wheel 31. Exciter wheel 31 thus rotates at a certain rotational speed $V_{ext}$, which is proportional to the angular excitation frequency or pulsation of the local oscillator. This exciter wheel 31 has a certain number N of peripheral teeth. The number of teeth N may be an odd number, for example the exciter wheel may have 9 teeth.

The reference oscillator or resonator of the feedback system has at least one permanent magnet 33 disposed at a free end of an arm 32 of the resonator, which is attached via a base 34 to a movable frame 35 mounted on a plate of the watch movement. This permanent magnet 33 is disposed in proximity to exciter wheel 31 and preferably the magnetic polarization of the magnet is oriented towards the centre of exciter wheel 31.

Permanent magnet 33 is attracted to exciter wheel 31 when a tooth is presented close to the magnet, and is much less attracted to the exciter wheel when the magnet faces an empty space between two of the exciter wheel teeth. Since the exciter wheel rotates at a certain rotational speed $V_{ext}$, magnet 33 will thus oscillate at a second frequency $\omega_0$ through magnetic interaction with said exciter wheel 31.

During the rotation of exciter wheel 31 and as a function of its number N of peripheral teeth, an excitation frequency $\omega_{ext}$ is determined on the basis of the natural rotational speed of the wheel $V_{ext}$. The excitation frequency $\omega_{ext}$ is therefore equal to $N \cdot V_{ext}$, where N is the number of teeth of the exciter wheel. The number of teeth N may be an odd number, for example the exciter wheel may have 9 teeth. It is therefore this excitation frequency $\omega_{ext}$, which can be compared to the oscillation frequency $\omega_0$ of the reference oscillator to compare the rate of the two oscillators.

Preferably, two arms 32, 32' may be provided, each with a permanent magnet 33, 33' mounted at their first end to define a tuning fork. The second ends of the two arms 32, 32' are joined and attached via base 34 to frame 35. The two permanent magnets 33, 33' are disposed in proximity to exciter wheel 31 and in diametrically opposite positions with exciter wheel 31 between the two permanent magnets 33, 33'.

Moving frame 35 is preferably a hollow wheel disposed coaxially to exciter wheel 31. This hollow wheel 35 is maintained in free rotation on the plate by means of rollers or pins or ball bearings 38 in contact with an inner surface of hollow wheel 35. The number of rollers or pins or ball bearings 38 must be at least three in order for the frame or hollow wheel to be able to rotate on the same axis of rotation as the exciter wheel. Frame or hollow wheel 35 is, however, maintained in a defined position by at least one return spring 36, or two return springs 36, 36' attached on one side to the plate. Preferably, the return springs 36, 36' are connected to the hollow wheel in diametrically opposite positions.

When exciter wheel 31 rotates at a certain rotational speed $V_{ext}$, the tuning fork reference oscillator will be excited at an oscillation frequency $\omega_0$. The excitation of the reference oscillator is obtained as a result of the rotation of exciter wheel 31, which is made of a ferromagnetic material for magnetic interaction with the permanent magnet or magnets 33, 33' carried at a first end of arms 32, 32'. Said exciter wheel 31 may also simply have ferromagnetic portions on or in the teeth for magnetic interaction with permanent magnets 33, 33'. There may also be a continuous deposit of ferromagnetic material over the peripheral teeth of exciter wheel 31. A magnetic interaction torque or lock torque thus also occurs. Since the rotation of the exciter wheel is in the counterclockwise direction, frame 35 will also tend to move in the counterclockwise direction, while being retained by return springs 36, 36'.

The rotational speed of exciter wheel 31 may increase gradually and then stabilise in principle close to the reference rotation frequency $\omega_0$. As indicated above, in such case there is a lock torque. However, if the interaction torque is further increased, the system unlocks and the speed of exciter wheel 31 is then limited only by friction. It is therefore sought to synchronize the rate of the two oscillators via the feedback system.

As also shown in FIG. 4, from the interaction torque with respect to the angular excitation frequency, when angular excitation frequency $\omega_{ext}$ is close to a lock frequency, there occurs a lock torque. Moving frame 35 will thus take a position that counterbalances the lock torque and the torque of return springs 36, 36'. The frame also includes a toothed portion for meshing, for example, with an output wheel 37. The angular position $\varphi$ of output wheel 37 thus proportionally represents the difference between the angular or rotation frequencies $\omega_{ext}-\omega_0$ to allow adjustment of the local oscillator via output wheel 37, which constitutes one of the elements of the regulating mechanism.

It is also to be noted that frame 35 and return springs 36, 36' can be incorporated in a one-piece component. Further, the reference oscillator may take a different form from a tuning fork. The permanent magnets may also be disposed on the exciter wheel with the ferromagnetic arms 32, 32' of the tuning fork. An end portion of each arm faces the exciter wheel to be excited by the rotation of said exciter wheel 31.

FIG. 5 shows a simplified view of a first embodiment of the feedback system regulating mechanism for regulating the rate or frequency of the local oscillator as a function of the difference determined in the frequency comparator of the feedback system. The local oscillator is represented in FIG. 5 only by balance 14 and balance spring 14'.

The regulating mechanism is represented by output wheel 37 of the feedback system, which meshes with a toothed base portion, for example, in the form of an arc of a circle, of a moving regulating member 137. The regulating member is mounted to rotate on the watch plate about an axis parallel to the axis of rotation of the balance, but outside of sprung balance 14. The regulating member thus includes a beak at the end of an arm opposite the toothed portion. The regulating beak is capable of moving closer to or further from a last coil of balance spring 14' as a function of an angle of rotation $\theta$ of the beak which depends on the frequency comparison in the feedback system.

The moving beak of regulating member 137 acts on the active length $L_0$ of the balance spring from a given elongation. The period of oscillation of the sprung balance depends on the active length of balance spring 14'. During oscillation, the balance spring alternately retracts and extends. If an obstacle, such as the stiff beak, is placed on the trajectory of extension of the last wheel of the spring, the active length of the spring is momentarily changed during the oscillation. This results in a decrease in the mean active length and thus a decrease in the oscillation period.

It is clear that it is also possible to envisage not using output wheel 37, but allowing the toothed portion of the frame to mesh directly with the toothed portion of regulating member 137.

FIG. 6 shows a simplified view of a second embodiment of the feedback system regulating mechanism for regulating the rate or frequency of the local oscillator as a function of the difference determined in the frequency comparator of the feedback system. As in FIG. 5, the local oscillator is represented in FIG. 6 only by balance 14 and balance spring 14'.

For this second embodiment of the regulating mechanism, regulating member 137 includes a toothed base portion, for example, in the form of the arc of a circle, which can mesh directly with the toothed portion of the frequency comparator frame. The regulating member is mounted to rotate on the watch plate about an axis parallel to the axis of rotation of the balance, but outside of sprung balance 14. The regulating member also includes an arched portion of complementary shape to an outer surface of balance 14 to vary the friction caused by air on the balance. This arched portion is disposed on a side opposite to the toothed portion with respect to the axis of rotation of the regulating member. As a function of the difference between rotation frequencies $\omega_{ext}-\omega_0$, the arched portion can move closer to or further from the outer surface of the balance to adjust the rate or frequency of the local oscillator. Thus, with careful selection of the isochronism curve of the sprung balance used, the sprung balance frequency decreases with the increase in friction caused by the arched portion of regulating member 137 approaching the balance, and vice versa.

It is to be noted that for the two embodiments described with reference to FIGS. 5 and 6, regulating member 137 can be moved linearly to adjust the oscillation frequency of sprung balance 14.

Adjustment of the oscillation frequency of balance 14 can also be achieved by a magnetic coupling between regulating member 137 and said balance in addition to friction caused by air.

As regards the feedback system and according to another embodiment, a different arrangement of the reference oscillator may be provided for magnetic interaction with the exciter wheel to determine the rate or frequency of the two oscillators. The exciter wheel may include magnetic tracks annularly arranged on one surface and regularly spaced from each other. These annularly distributed magnetic tracks are centred on the axis of rotation of the exciter wheel. When the exciter wheel rotates, at least one magnetic coupling element, which is a permanent magnet of the reference oscillator, is excited by each rotating magnetic track of the exciter wheel. This permanent magnet is elastically maintained on a moving frame, which can move angularly or linearly to compare the frequency of the two oscillators and to enable a regulating mechanism to adjust the oscillation frequency of the sprung balance.

Figure 7:
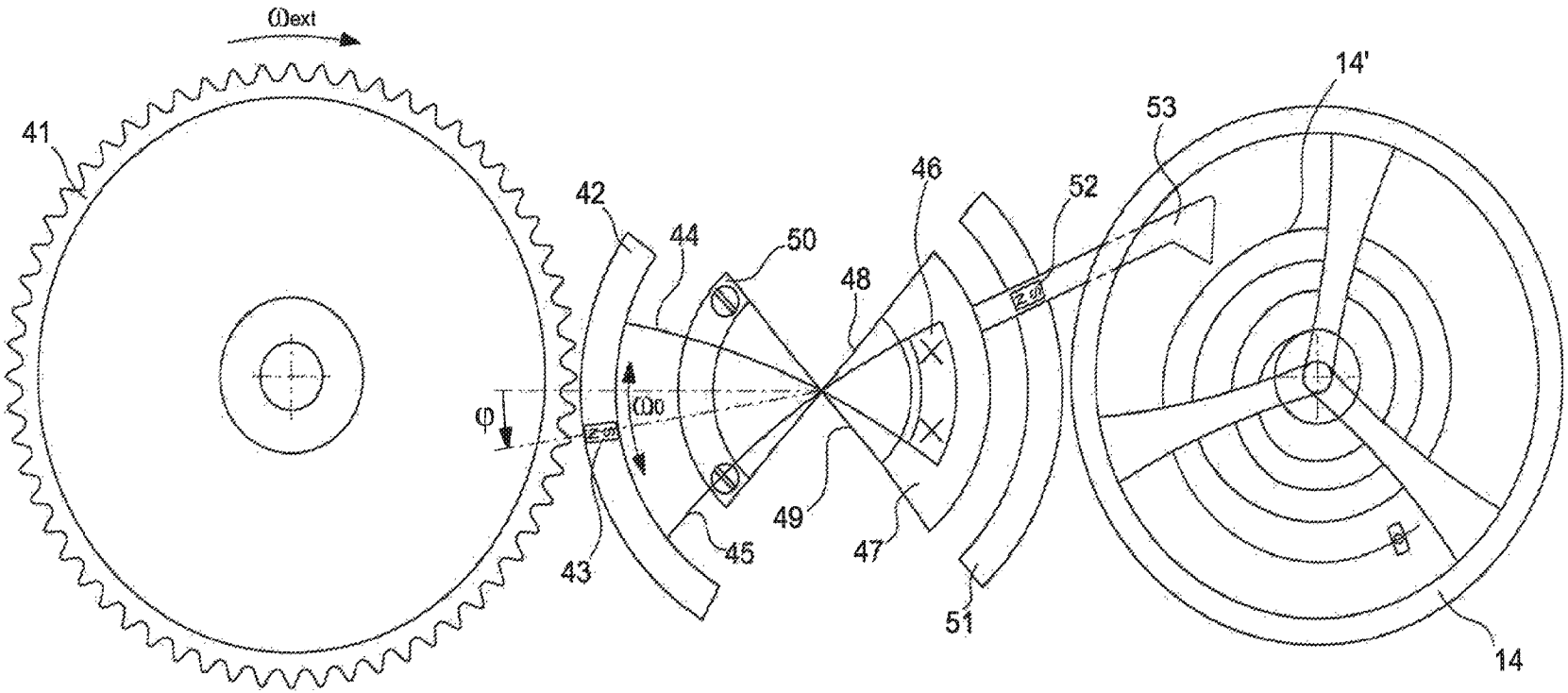
FIG. 7 shows a simplified view of the components of the feedback system according to a second embodiment with an input exciter wheel for comparing the rate of the local oscillator and of the reference oscillator of the feedback system according to the invention.

FIG. 7 shows a second embodiment of the feedback system. In this second embodiment, the reference oscillator is integrally combined with the frequency comparator to control the regulating mechanism. There is also a magnetic interaction with a rotating wheel connected to the conventional mechanical movement to excite the reference resonator and to compare the rate or frequency of the oscillators.

As explained in detail with reference to FIG. 3, exciter wheel 41 of this second embodiment can be directly connected to one of the wheels of the set of gear wheels of the conventional mechanical movement. Exciter wheel 41 may thus be the last wheel in the set of gear wheels or a wheel in an arrangement of gear wheels connected to the set of gear wheels. Exciter wheel 41 rotates at a rotational speed $V_{ext}$ representative of the frequency of the local oscillator, i.e. proportional to the oscillation frequency of sprung balance 14. Exciter wheel 41 can excite a reference oscillator, which in this case is a crossed strip resonator.

The reference oscillator or resonator is a resonator with crossed strips 44, 45, 48, 49. It includes, on an arched sector 42, at least one permanent magnet 43 close to toothed exciter wheel 41. The stiff arched sector, which may be made of metallic material, is connected via two first crossed flexible strips 44, 45 to a first base plate 46. These first crossed elastic strips 44, 45 extend at a distance from each other in two parallel planes. These two parallel planes are also parallel to the plane of exciter wheel 41, and to the watch plate, on which are mounted the various elements of the mechanical movement and of the feedback system.

The first base plate 46 is also fixed on a second plate 47 of a complementary part of the crossed strip resonator. This second plate 47 is connected via two second crossed flexible strips 48, 49 to a securing plate 50, which is fixedly mounted on the watch plate. These second crossed elastic strips 48, 49 extend at a distance from each other in two parallel planes, which are also parallel to the two planes of the first elastic strips 44, 45. These second crossed flexible strips 48, 49 are situated between first elastic strips 44, 45 and the watch plate.

The first and second base plates 46, 47 are movable and move angularly as a function of the lock torque between the resonator and the wheel. The first and second base plates 46, 47 are illustrated in arched form, but may take another general shape, such as a rectangular parallelepiped, and form only one piece. During the rotation of exciter wheel 41, which is preferably made of ferromagnetic material, arched sector 42 with its permanent magnet 43 oscillates at a frequency $\omega_0$ in the plane of the exciter wheel. A magnetic interaction occurs and, as a function of the rotational speed of the exciter wheel, there is an angular displacement of plates 46, 47 caused by a defined lock torque.

In this second embodiment, the regulating mechanism is formed here by a regulating beak 53, which is attached, for example, to second base plate 47. A second permanent magnet 52 is disposed on regulating beak 53 cooperating, for example, with an aluminium plate 51 disposed underneath the beak and on the watch plate. This aluminium plate 51 can attenuate the vibrations of beak 53 following the oscillation of arched sector 42 acting like a Foucault brake.

As a function of the comparison of rotation frequencies $\omega_{ext}-\omega_0$, plates 46 and 47 are displaced with respect to their position of equilibrium. The angular displacement of plates 46, 47 moves beak 53 in the direction of balance spring 14' of balance 14 to regulate the oscillation frequency of the local oscillator, as explained with reference to FIG. 5. If sprung balance 14 oscillates at a too low frequency, beak 53 heads towards the last coil of balance spring 14' to reduce the active length of said spring, and vice versa if the oscillation frequency is too high.

According to a different variant embodiment, arched sector 42 could be replaced by a flywheel carrying at least one permanent magnet 43 or having a magnetized portion made in the metallic material of the flywheel to be excited by exciter wheel 41 as it rotates. The flywheel may be connected to first base plate 46 by the two first crossed flexible strips 44, 45 remote from each other and intersecting on a virtual pivot axis parallel to the axis of rotation of the exciter wheel. The crossed strips may be disposed at an angle $\alpha$ relative to the pivot axis, which may be comprised between 60° and 80°.

The two second crossed flexible strips 48, 49 are also remote from each other, but disposed between the first crossed strips 44, 45 and the watch plate, on which is fixed securing plate 50 of the combined reference oscillator and frequency comparator.

From the description that has just been given, several variant embodiments of the mechanical timepiece movement provided with a feedback system for the movement can be devised by those skilled in the art without departing from the scope of the invention defined by the claims. It is possible to envisage providing the exciter wheel with at least one permanent magnet to interact with a ferromagnetic metallic portion of the reference resonator in order to make it oscillate at a determined frequency. The exciter wheel may be a circular wheel with no teeth, but with ferromagnetic portions regularly spaced from each other and disposed over the entire periphery of the exciter wheel to interact magnetically with the permanent magnets of the reference oscillator. The frequency comparator frame can be linearly displaced when an arm or a magnetized element of the reference oscillator is magnetically coupled with the exciter wheel to control the adjustment of the regulating mechanism.

What is claimed is:

1. A mechanical timepiece movement, which includes at least one barrel, a set of gear wheels driven at one end by the barrel, and an escapement mechanism of a local oscillator with a resonator in the form of a sprung balance, the escapement mechanism being driven at another end of the set of gear wheels, and a feedback system for the timepiece movement, wherein the feedback system includes a precise reference oscillator combined with a frequency comparator for comparing the frequency of the two oscillators and a mechanism for regulating the resonator of the local oscillator to slow down or accelerate the resonator based on the result of a comparison in the frequency comparator, wherein the reference oscillator of the feedback system is excited by magnetic interaction via a rotating exciter wheel in connection with a wheel of the set of gear wheels, and wherein the exciter wheel is a toothed wheel made of ferromagnetic material, and wherein the reference oscillator includes at least one permanent magnet disposed at a first end of an arm, which is secured via a base to a moving frame of the frequency comparator, the permanent magnet being disposed in proximity to the exciter wheel to be attracted by the passing of each tooth of the rotating exciter wheel and to generate an oscillation at a reference frequency of the reference oscillator.

2. The mechanical timepiece movement according to claim 1, wherein the reference oscillator includes two arms attached to the base, a first end of each arm respectively carrying a permanent magnet as first and second permanent magnets to form a tuning fork, and wherein the first and second permanent magnets are attracted to the rotating exciter wheel on the passage of each tooth.

3. The mechanical timepiece movement according to claim 2, wherein the first and second permanent magnets are disposed in proximity to the exciter wheel and in diametrically opposite positions, with the exciter wheel between two permanent magnets.

4. The mechanical timepiece movement according to claim 2, wherein the exciter wheel includes an odd number N of teeth.

5. The mechanical timepiece movement according to claim 4, wherein the number N of teeth of the exciter wheel is at least equal to 9.

6. The mechanical timepiece movement according to claim 1, wherein the moving frame of the frequency comparator is mounted on a plate of the mechanical timepiece movement while being maintained in a defined position via at least one return spring in order to be linearly or angularly displaced as a function of the difference in frequency of the two oscillators.

7. The mechanical timepiece movement according to claim 6, wherein the moving frame is a hollow wheel disposed coaxially to the exciter wheel, the hollow wheel being mounted for free rotation on the plate by rollers or pins or ball bearings, and wherein the frame is maintained in a defined position via two return springs connected to the frame in diametrically opposite positions.

8. The mechanical timepiece movement according to claim 6, wherein, as a function of the rotational speed $V_{ex}$, of the exciter wheel and of the number N of teeth of said exciter wheel defining an excitation frequency $\omega_{ext}$ equal to $N \cdot V_{ext}$, the moving frame of the frequency comparator is arranged to be angularly displaced proportionally to the difference between the oscillation frequency $\omega_0$ of the reference oscillator and the excitation frequency $\omega_{ext}$ to control the regulating mechanism and to adjust the oscillation frequency of the sprung balance.

9. The mechanical timepiece movement according to claim 1, wherein the regulating mechanism includes at least one regulating member connected to the frequency comparator, the at least one regulating member being arranged to be linearly or angularly displaced to adjust the oscillation frequency of the sprung balance.

10. The mechanical timepiece movement according to claim 9, wherein the regulating member, which is mounted to rotate on a plate, includes a base portion driven at the output of the frequency comparator and a beak-shaped portion capable of moving closer to or further from a last coil of a balance spring of the sprung balance as a function of an angle of rotation of the beak dependent on the frequency comparison in the feedback system.

11. The mechanical timepiece movement according to claim 9, wherein the regulating member, which is mounted to rotate on a plate, includes a base portion driven at the output of the frequency comparator and an arched portion of complementary shape to an external surface of the balance to vary the friction caused by air on the balance depending on the frequency comparison in the feedback system.

12. The mechanical timepiece movement according to claim 1, wherein the exciter wheel includes at least portions of ferromagnetic material regularly spaced from each other and disposed over the entire periphery of the exciter wheel to interact magnetically with at least one permanent magnet of the reference oscillator.

13. The mechanical timepiece movement according to claim 1, wherein the exciter wheel includes at least ferromagnetic portions on or in teeth of the exciter wheel to interact magnetically with at least one permanent magnet of the reference oscillator.

14. The mechanical timepiece movement according to claim 1, wherein the exciter wheel includes a continuously deposited layer of ferromagnetic material on peripheral teeth of the exciter wheel to interact magnetically with at least one permanent magnet of the reference oscillator.

15. The mechanical timepiece movement according to claim 1, wherein the exciter wheel includes regularly spaced permanent magnets disposed at the periphery of the exciter wheel to interact magnetically with at least one arm made of ferromagnetic material of the reference oscillator in order to cause said oscillator to oscillate at a determined reference frequency.

16. The mechanical timepiece movement according to claim 1, wherein the exciter wheel is arranged to excite by magnetic interaction the reference oscillator in the form of a crossed strip resonator.

17. The mechanical timepiece movement according to claim 16, wherein the crossed strip resonator includes an arched sector or a circular flywheel with a magnetized portion or at least one permanent magnet closely facing the exciter wheel or having portions of ferromagnetic material regularly spaced from each other and arranged at the periphery, wherein the arched sector or the circular flywheel is connected by two first crossed flexible strips to a first moving base plate, the first elastic strips extending at a distance from each other in two parallel planes, wherein the first moving base plate is secured on a second moving base plate, wherein the second base plate is connected by two second crossed flexible strips to a securing plate, which is fixedly mounted on a plate of the mechanical timepiece movement, the second crossed elastic strips extending at a distance from each other in two parallel planes, which are also parallel to the two planes of the first elastic.

18. The mechanical timepiece movement according to claim 17, wherein the first and second base plates of the frequency comparator are angularly displaced as a function of the frequency comparison of the two oscillators to control the regulating mechanism.

19. The mechanical timepiece movement according to claim 18, wherein the regulating mechanism includes a regulating beak attached to the first and second base plates, the beak being capable of moving closer to or further from a last coil of the balance spring depending on the oscillator frequency comparison in the feedback system.

20. The mechanical timepiece movement according to claim 19, wherein the regulating beak includes a permanent braking magnet above an aluminium plate disposed on a plate of the mechanical timepiece movement to attenuate the vibrations of the regulating beak.

* * * * *